US005195805A

United States Patent [19]

Clapham

[11] Patent Number: 5,195,805

[45] Date of Patent: Mar. 23, 1993

[54] WATER SPRAY NOZZLE FOR USE WITH A MINERAL PICK BOX

[75] Inventor: Stephen W. Clapham, Sheffield, England

[73] Assignee: Hydra Tools International PLC, Sheffield, England

[21] Appl. No.: 794,567

[22] Filed: Nov. 19, 1991

[30] Foreign Application Priority Data

Nov. 29, 1990 [GB] United Kingdom ..... 9025934

[51] Int. Cl.[5] ..... E21C 35/22

[52] U.S. Cl. ..... 299/81; 239/600

[58] Field of Search ..... 299/81, 92, 17; 175/393, 424; 239/600, DIG. 8

[56] References Cited

U.S. PATENT DOCUMENTS 4,542,942 9/1985 Zitz et al. ..... 299/81
4,555,143 11/1985 Wrulich et al. ..... 299/81

FOREIGN PATENT DOCUMENTS 193268 9/1986 European Pat. Off. .
2000051 1/1979 United Kingdom .
2054007 2/1981 United Kingdom ..... 299/81
2165287 4/1986 United Kingdom ..... 299/81

*Primary Examiner*—David J. Bagnell
*Attorney, Agent, or Firm*—Trexler, Bushnell, Giangiorgi & Blackstone, Ltd.

[57] ABSTRACT

A water spray nozzle for use with a pick box includes an elongate body member of circular section, and a head having a water discharge aperture with a water conveying passage communicating between the discharge aperture and a water inlet end of the passage. Intermediate the ends of the nozzle is a recess which can be engaged, in use, by a wire-like fastener adapted to latch the spray nozzle mechanically in a receiving bore of the pick box. A circumferential groove in the nozzle carries a resilient O-ring adapted, in use, to provide a water seal by engaging the receiving bore of the pick box.

20 Claims, 2 Drawing Sheets

WATER SPRAY NOZZLE FOR USE WITH A MINERAL PICK BOX

This invention relates to mineral mining equipment and specifically to a water spray nozzle for use with a pick box adapted to receive a mineral cutter pick; a mineral cutter pick box provided with such a nozzle; to a pick and box combination; and to a rotary cutting head provided with such a pick box, or pick and box combination.

Due to their propensity for blockage with mine debris, particularly for instance when a coal cutting machine is idle over a weekend, there is a requirement to have water spray nozzles removable for cleaning or even replacement, and hence screw threaded nozzles, and consequently tapped receiving bores are an obvious means of achieving this requirement, but removal and indeed re-fitting of a screw threaded nozzle in situ on a coal face is not easy, especially as rust may have developed. Consequently proposals have been made for avoiding screw threads. Thus, screwless spray nozzles and their receiving holders a described in GB 2000051 have been used extensively in the British coal mining industry. In another screwless system (known in practice) a screwless spray nozzle is retained in a receiving holder by a staple, the limbs of which pass along holes in the holder and into a circumferential groove in the nozzle. However, to achieve accurate targeting of the issuing water, particularly if a coherent jet (in contrast to a spray) of water is required, accurate welding of the holder e.g. onto a rotary cutting head, is required, but is not always achieved.

In addition, the picks and boxes in accordance with EP 0193268 have proved effective in practice in their primary function of protecting the spray nozzle from mechanical damage and minimising blockage by debris, so that the water spray generated remains effective in enveloping at source sparks that may be generated in the so-called incendive sparking zone to the rear of a pick.

There are however four industry-standard styles of pick and box combination viz (i) a forward attack pick (FIG. 1 of EP 0193268);

(ii) a radial/shearer pick (FIG. 2 of EP 0193268);

(iii) a semi-forward attack pick (FIGS. 3 to 6 of EP 0193268); and (iv) a point attack pick, each pick box of each standard requiring the axis of the spray nozzle, and hence the water supply bore to be drilled at a different angle. The heel of the pick requires a similar angled drilling. Also the water supply bore needs to be tapped to receive a screw-in spray nozzle, and the potential drawbacks of screw-in nozzles have already been discussed.

According to a first aspect of the present invention there is provided a water spray nozzle for use with a pick box, comprising an elongate body member of circular section, a head having a water discharge aperture, a water conveying passage communicating between the discharge aperture and a water inlet end of the passage, and with a recess intermediate the ends of the nozzle to be engaged, in use, by a wire like retainer adapted, in use, to latch the spray nozzle mechanically in a receiving bore of a pick box, while a circumferential groove in the nozzle carries a resilient 'O'-ring adapted, in use, to constitute a water seal by engaging the receiving bore of the pick box.

The water discharge aperture may be co-axial with the longitudinal axis of the body member or at an angle inclined with respect to the longitudinal axis of the body member. The geometry of the water discharge aperture may be such that it generates discharge of a coherent jet of water or a spray of water droplets. To achieve the latter, the nozzle is provided with a swirl unit located upstream of the discharge aperture. If the aperture is not co-axial whereby discharge is required to be in a specific direction, then the recess may take the form of a nozzle-orienting flat.

Preferably, the nozzle is formed from two parts welded or otherwise secured together, being a body part and a head part. The head part is preferably hollow to provide a water receiving chamber in fluid flow communication with its discharge aperture, and housing the swirl unit. The water conveying passage, which may for instance be a longitudinal bore in the body part, is preferably provided at its lower end with a filter such as a metal gauze, while the 'O'-ring is carried adjacent the lower end of the body member. Also the nozzle may be provided towards its upper end with a second 'O'-ring seal to constitute a dust/debris seal.

According to a second aspect of the present invention there is provided a pick box having an elongate aperture adapted to receive the shank of a mineral cutter pick, a water supply bore provided in a portion of the box spaced from the aperture and emerging at a seating surface of the box which seating surface is adapted to be engaged by an abutment surface of the pick, a water spray nozzle in accordance with the first aspect fitted into the bore, a retaining bore intersecting the water supply bore, and a push-in, pull-out wire-like retainer being a tight spring fit within the retaining bore and engageable partly in the recess of the nozzle to latch the nozzle mechanically within the bore.

The water discharge aperture may terminate in the vicinity of the seating surface of a box adapted to receive a so-called point attack pick, while for so-called radial/shearer, forward attack or semi-forward attack picks, the discharge aperture may project beyond the seating surface by a distance approximating to the thickness of a heel which is conventionally provided on these three last mentioned types of pick.

The wire-like retainer may conveniently be "L"-shaped, preferably of spring steel, with the longer limb adapted to penetrate the retaining recess and being bowed, while the side face of the pick box is provided with a groove to accommodate the shorter limb to protect that limb from damage and yet leave the shorter limb exposed to view so as to be readily engageable by a simple tool such as a screwdriver blade, for removal of the wire-like retainer and hence the nozzle for cleaning and/or replacement of the latter.

According to a third aspect of the invention, there is provided a pick box in accordance with the second aspect, in combination with a suitable pick, the latter having a heel provided with an aperture of dimensions exceeding the end of the nozzle projecting beyond the seating surface of the pick box, such that the pick shank can be readily fitted into the receiving aperture of the box, simultaneously with the aperture being readily fitted over the projecting end of the nozzle, while the heel has a height approximating to the length of projection of the nozzle end.

The proposals in accordance with the various aspects of the invention result not only in production cost reduction, but also in enhanced spray performance compared with prior art proposals. For instance with regard to production cost reduction for the system of EP 0193268, a single box may now serve for all four types of pick, while the nozzle receiving bore need not be at various angles, but more simply can always be drilled at 90° to the abutment surface, as different water spray forms can be generated by use of different discharge aperture configurations for a series of nozzles. Furthermore because of the wire retention of the nozzle, the latter need not be screw threaded and the bore tapped as in EP 0193268, or GB 2000051.

The equipment in accordance with the invention will now be described in greater detail, by way of examples, with reference to the accompanying drawings, in which.

Figure 1:
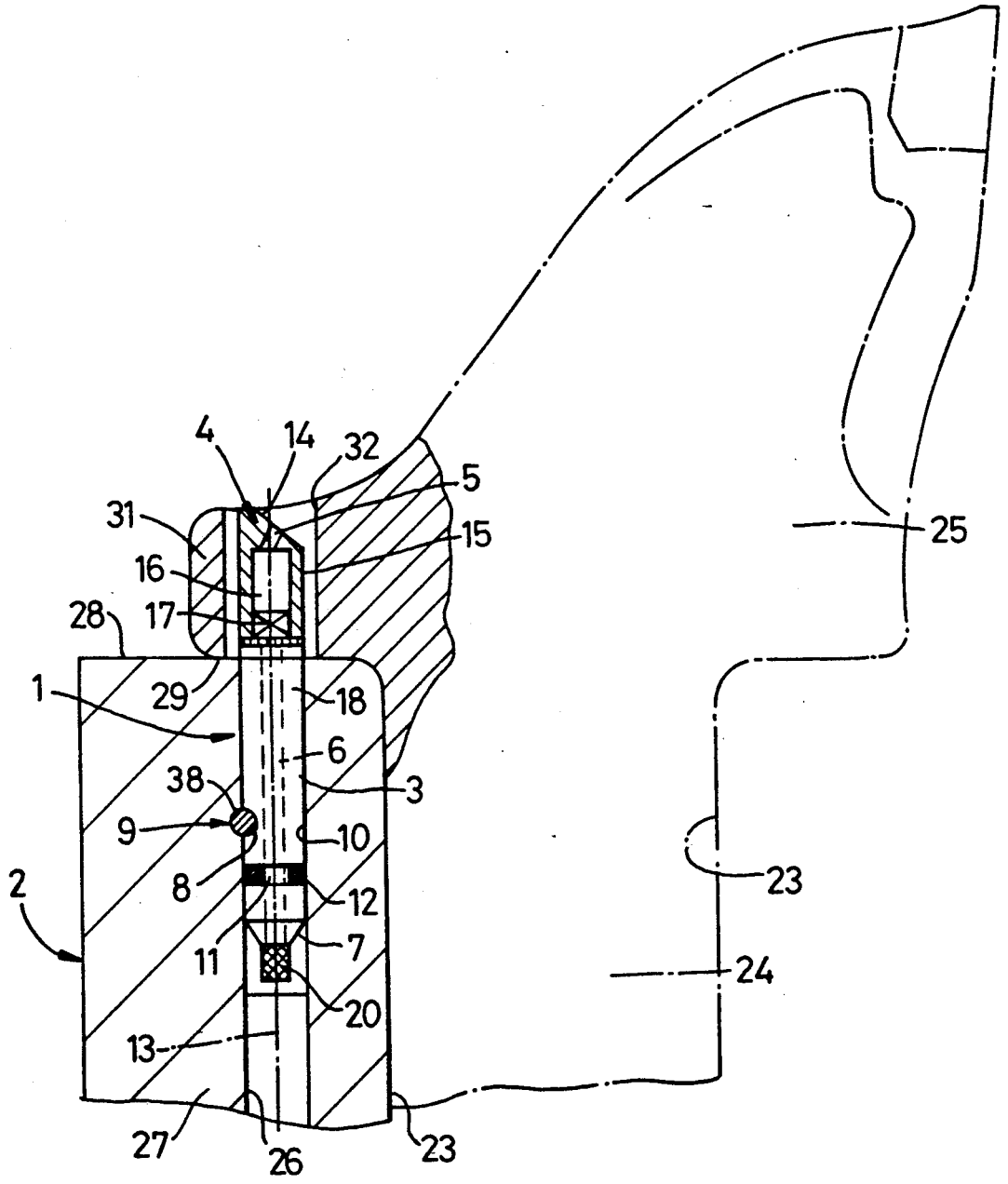
FIG. 1 is a part sectional view through a first embodiment of nozzle, pick box and a pick and box combination.
Figure 2:
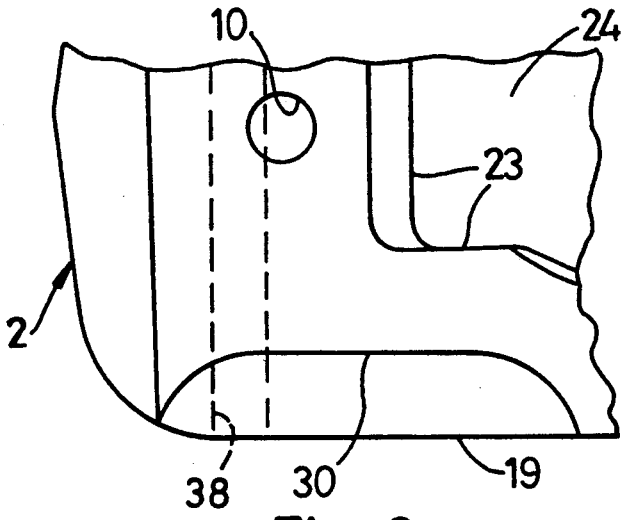
FIG. 2 is a plan view of part of FIG. 1.
Figure 3:
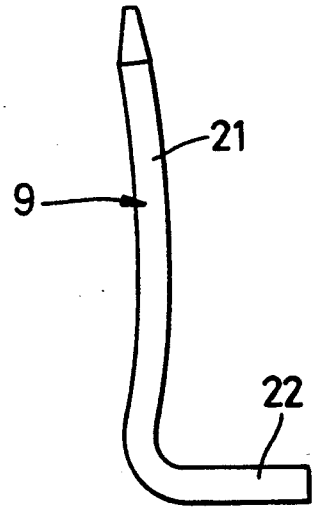

FIG. 3 details the wire retainer of FIGS. 1 and 2; and

Figure 4:
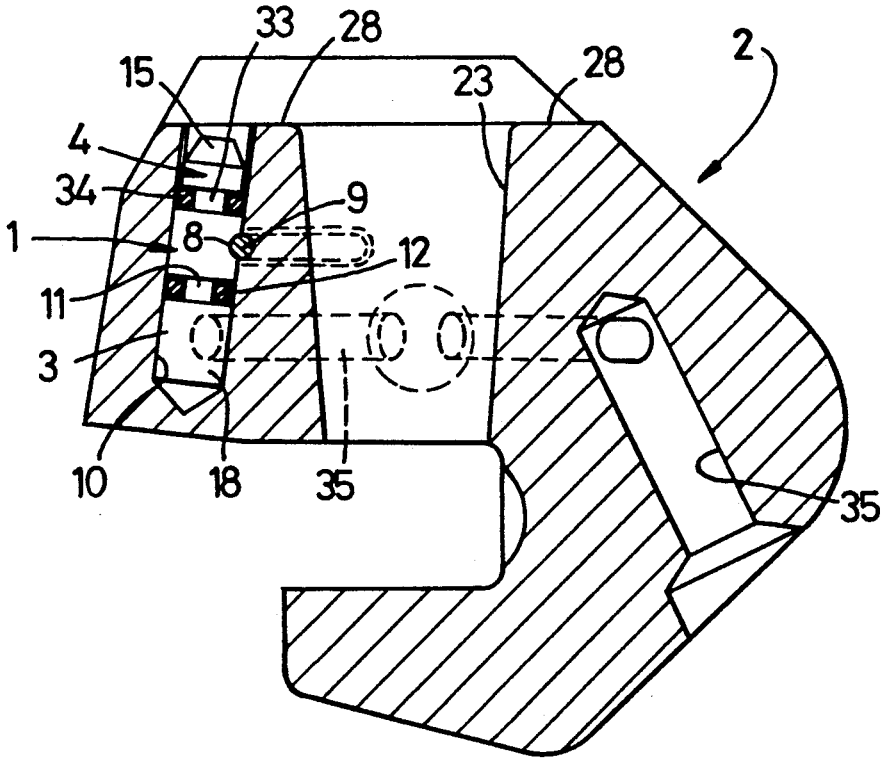

FIG. 4 corresponds to FIG. 1 but shows a second embodiment of nozzle and pick box.

In the drawings a water spray nozzle 1 for use with a pick box 2, comprising an elongate body member 3 of circular section, a head 4 having a water discharge aperture 5, a water conveying passage 6 communicating between the discharge aperture 5 and a water inlet end 7 of the passage 6, and with a recess 8 intermediate the ends of the nozzle 1 to be engaged, in use, by a wire-like fastener 9 adapted, in use, to latch the spray nozzle 1 mechanically in a receiving bore 10 of a pick box 2, while a circumferential groove 11 in the nozzle 1 carries a resilient 'O'-ring 12 adapted, in use, to constitute a water seal by engaging the receiving bore 10 of the pick box 2. In the embodiment illustrated in FIG. 1, the water discharge aperture 5 is not co-axial with the longitudinal axis 13 of the nozzle 1, but is provided in a chamfer 14, so that the aperture 5 is approximately at 30° to the axis 13. With this form of nozzle, the recess 8 is a flat to ensure correct orientation of the discharge aperture 5. In detail, the nozzle 2 comprises a hollow head part 15 providing a water receiving chamber 16 in fluid flow communication with the discharge aperture 5 and housing a swirl unit 17. The head part 15 is welded to a body part 18 in which the recess 8 and circumferential groove 11 are formed. The water conveying passage is in fact constituted by a co-axial bore along the body part 18 extending to the lower, water inlet end 7 remote from the head part 15, which lower end 7 carries a metal gauze filter 20.

The retainer 9 is "L"-shaped, of spring steel, having a longer, bowed limb 21 and a shorter limb 22. The pick box 2 has an elongate aperture 23 adapted to receive the shank 24 of a mineral cutter pick 25. Beneath the nozzle 1, the receiving bore 10 extends as a water supply bore 26 provided in a portion 27 of the box 2 spaced from the aperture 23 and emerging at a seating surface 28 of the box 2 which seating surface 28 is adapted to be engaged by an abutment surface 29 of the pick 25. In FIG. 1, when a water spray nozzle 1 is fitted into the bore 10 the nozzle 1 terminates approximately at the seating surface 28 or, as illustrated in FIG. 4, projects beyond the seating surface 28, with the wire-like retainer 9 being a tight push-in, pull-out, spring fit within a receiving bore 38 drilled into the pick box 2 so as to intersect the nozzle receiving bore 10, and with the side face 19 of the pick box 2 being provided with a groove 30 to accommodate the shorter limb 22.

The pick of FIG. 1 is of a kind provided with a heal 31. In the heal 31 is provided a bore 32, or a slot, of dimensions to accommodate, with clearance, the head part 15 of the nozzle 1, which part projects beyond the seating surface 28 by a distance approximating to the thickness of the heal 31.

In the embodiment of FIG. 4, the aperture 23 is frusto-conical, to receive a similarly profiled shank of a pick (not shown) while the head part 15 does not project, but terminates at the seating surface 28, and a second circumferential groove 33 in the nozzle 1 adjacent the head part 15, receives a second resilient "O"-section sealing ring 34 to prevent debris ingress into the bore 10, with water : supplied to the bore 10 via bores 35.

What is claim is:

1. A water spray nozzle for use with a pick box, comprising an elongate body member of circular section, a head having a water discharge aperture of such geometry that it generates the discharge of a spray of water droplets, a water conveying passage communicating between said discharge aperture and a water inlet end of said passage, and a recess located intermediate opposite ends of said nozzle, with said recess adapted to be engaged, in use, by a wire like fastener adapted to latch said nozzle mechanically in a receiving bore of an associated pick box, a circumferential groove also being provided in said nozzle and carrying a resilient 'O'-ring adapted, in use, to constitute a water seal by engaging said receiving bore of said pick box, and a water swirl unit located upstream of said discharge aperture.

2. A nozzle as claimed in claim 1, wherein said water discharge aperture is co-axial with a longitudinal axis of the body member.

3. A nozzle as claimed in claim 1, wherein said water discharge aperture is at an angle inclined with respect to a longitudinal axis of said body member.

4. A nozzle as claimed in claim 3, wherein said recess takes the form of a nozzle-orienting flat.

5. A nozzle as claimed in claim 1, wherein said water discharge aperture is of such geometry that it generates the discharge of a coherent jet of water.

6. A nozzle as claimed in claim 1, formed from two parts being a body par and a head part secured together.

7. A nozzle as claimed in claim 1, wherein a longitudinal bore in the body member constitutes said water conveying passage.

8. A nozzle as claimed in claim 7, formed from a body part and a head part, wherein a filter is provided at an end of said longitudinal bore remote from head part.

9. A nozzle as claimed in claim 8, wherein a metal gauze constitutes said filter.

10. A nozzle as claimed in claim 8, wherein said 'O'-ring is carried at an end of said body member adjacent said filter.

11. A water spray nozzle for use with a pick box, comprising an elongate body member of circular section, a head having a water discharge aperture, a water conveying passage communicating between said discharge aperture and a water inlet end of said passage, and a recess located intermediate opposite ends of said nozzle, with said recess adapted to be engaged, in use, by a wire like fastener adapted to latch said nozzle mechanically in a in a receiving bore of an associated pick box, a circumferential groove also being provided in said nozzle and carrying a resilient 'O'-ring adapted, in use, to constitute a water seal by engaging said receiving bore of said pick box, said nozzle being formed from two parts being a body part and a head part secured together, wherein said head part is hollow to provide a water receiving chamber in fluid flow communication with said discharge aperture.

12. A nozzle as claimed in claim 11, provided with a water swirl unit, wherein said hollow chamber also houses said swirl unit.

13. A water spray nozzle for use with a pick box, comprising an elongate body member of circular section, a head having a water discharge aperture, a water conveying passage communicating between said discharge aperture and a water inlet end of said passage, and a recess located intermediate opposite ends of said nozzle, with said recess adapted to be engaged, in use, by a wire like fastener adapted to latch said nozzle mechanically in a receiving bore of an associated pick box, a circumferential groove also being provided in said nozzle and carrying a resilient 'O'-ring adapted, in use, to constitute a water seal by engaging said receiving bore of said pick box, said head provided with a second 'O'-ring seal, to constitute a dust/debris seal, adjacent said head.

14. A pick box having an elongate aperture adapted, in use, to receive a shank of a mineral cutter pick, a water supply bore provided in a portion of said box spaced from said aperture and emerging at a seating surface of said box, which seating surface is adapted, in use, to be engaged by an abutment surface of said pick, a water spray nozzle comprising an elongate body member of circular section;, a head having a water discharge aperture, a water conveying passage communicating between said discharge aperture and a water inlet end of said passage, and a recess located intermediate opposite ends of said nozzle, with said recess adapted to be engaged, in use, by a wire like fastener adapted to latch said nozzle mechanically in a receiving bore of said pick box, a circumferential groove also being provided in said nozzle, a water swirl unit located upstream of said discharge aperture, and carrying a resilient 'O'-ring to constitute a water seal by engaging said receiving bore of said pick box, said water discharge aperture terminating approximately at said seating surface, a retaining bore intersecting said receiving bore, and a push-in, pull-out wire-like fastener being a tight spring fit within said retaining bore and engageable partly in said recess to latch said nozzle mechanically within said receiving bore.

15. A pick box as claimed in claim 14, wherein said water discharge aperture terminates in the vicinity of said seating surface of said box.

16. A pick box as claimed in claim 14, wherein said discharge aperture projects beyond said seating surface by a distance approximating to the thickness of a heel of a pick intended, in use, to be fitted into said box.

17. A pick box as claimed in claim 14, wherein said wire-like fastener is 'L'-shaped.

18. A pick box as claimed in claim 17, wherein a longer limb of said fastener is bowed.

19. A pick box as claimed in claim 18, wherein a groove is provided in a side face of said pick box to accommodate the shorter limb of said fastener.

20. A pick box as claimed in claim 14, in combination with a pick, a heel provided on said pick, an aperture provided in said heel said aperture being of such dimensions that with an end of said nozzle projecting beyond a seating surface of said pick box, not only can said pick shank be readily fitted into said receiving aperture of said box, but also can said aperture be simultaneously and readily fitted over said projecting end of said nozzle, while said heel has a height approximating to the length of projection of said end of said nozzle.

* * * * *